US006761967B2

(12) United States Patent
De Neef

(10) Patent No.: US 6,761,967 B2
(45) Date of Patent: Jul. 13, 2004

(54) PREFABRICATED EXTERNAL REINFORCEMENT PLATE FOR STRUCTURAL MEMBERS

(75) Inventor: Dirk Christiaan Jozef Isidoor De Neef, Edegem (BE)

(73) Assignee: Immo Emergo, Naamloze Vennootschap, Wilrijk (BE)

( * ) Notice: Subject to any disclaimer, the term of this patent is extended or adjusted under 35 U.S.C. 154(b) by 0 days.

(21) Appl. No.: 10/169,105

(22) PCT Filed: Jan. 10, 2001

(86) PCT No.: PCT/BE01/00005

§ 371 (c)(1),
(2), (4) Date: Jul. 15, 2002

(87) PCT Pub. No.: WO01/51735

PCT Pub. Date: Jul. 19, 2001

(65) Prior Publication Data

US 2002/0193025 A1 Dec. 19, 2002

(30) Foreign Application Priority Data

Jan. 13, 2000 (BE) ..... 2000/0027

(51) Int. Cl.[7] ..... B32B 27/12

(52) U.S. Cl. ..... 428/298.1; 428/105; 428/113; 428/293.4; 428/297.4; 428/299.1; 428/299.4; 428/299.7; 428/300.7; 442/304

(58) Field of Search ..... 442/304, 181; 428/105, 113, 293.4, 293.7, 297.4, 298.1, 299.1, 299.4, 299.7, 300.7

(56) References Cited

U.S. PATENT DOCUMENTS

| | | | | |
|---|---|---|---|---|
| 5,910,352 | A | * | 6/1999 | Tingley |
| 6,387,479 | B1 | * | 5/2002 | Hayashi et al. |
| 6,475,580 | B1 | * | 11/2002 | Wright |
| 2002/0034624 | A1 | * | 3/2002 | Harpell et al. |

FOREIGN PATENT DOCUMENTS

| | | | |
|---|---|---|---|
| EP | 0799951 | * | 10/1997 |
| EP | 0859085 | * | 8/1998 |

* cited by examiner

*Primary Examiner*—Deborah Jones
*Assistant Examiner*—Wendy Boss
(74) *Attorney, Agent, or Firm*—Bacon & Thomas, PLLC

(57) ABSTRACT

The invention relates to an external reinforcement for beams, columns, plates and the like, substantially consisting in the combination of fibers and a resin and whereby the majority of the fibers is situated in the longitudinal direction of the reinforcement, characterized in that at least well-defined portions of the external reinforcement are provided with an additional reinforcement formed by fibers which are arranged according to at least one direction differing from the longitudinal direction of the reinforcement.

7 Claims, No Drawings

PREFABRICATED EXTERNAL REINFORCEMENT PLATE FOR STRUCTURAL MEMBERS

BACKGROUND OF THE INVENTION

The present invention relates to an external reinforcement for beams, columns, plates and the like, more particularly a reinforcement which allows to increase the maximum permissible load of existing beams, columns or the like, made of wood, concrete, metal or another material.

It is known that for reinforcing existing constructions, external reinforcements are provided which consist of, for example, a steel sheet, whereby this latter is attached to such construction by means of glue, bolts or the like.

Such known external reinforcement, however, shows the disadvantage that, on one hand, it is very heavy and, on the other hand, it is difficult to attach.

In order to eliminate said disadvantages, already an alternative external reinforcement has been proposed, which reinforcement consists of a plate formed of fibers, such as, for example, carbon fibers, glass fibers or aramide fibers, which are embedded in a resin.

Up to the present, such reinforcement is provided in a continuous process, for example, by pultrusion.

By means of this known technique, it is in fact possible to realize an external reinforcement having a well-defined composition, a very large length, a constant width and thickness, and a smooth surface.

Although such external reinforcement is considerably less heavy and can be provided relatively easy in comparison to external reinforcements consisting of sheets, it shows the considerable disadvantage that all fibers are situated in the longitudinal direction of the plate-shaped reinforcement, such that such plates can take up forces only in their longitudinal direction.

In fact, the forces which in this case are exerted on the fibers are transferred to the surrounding fibers only by means of the resin.

Moreover, it is not possible to drill openings in such known reinforcing plates, in consideration of the fact that this would result in a local interruption of some fibers, such that also the forces exerted on the thus interrupted fibers can not be transferred on the surrounding fibers.

Another disadvantage of the known external reinforcements is that the surface thereof is very smooth as a result of the production method of such plates, as a result of which the adherence thereof on a construction to be reinforced is rather small, such that, in order to improve such adherence, this surface generally is treated with the intention of roughening it, for example, by sandblasting, scouring or treating it in another manner, which, however, is very labour-intensive. Moreover, the fibers may be damaged by such treatment, as a result of which the strength of the reinforcing plate is reduced.

SUMMARY OF THE INVENTION

The present invention thus has an external reinforcement as its object which excludes the aforementioned and other disadvantages of the known additional reinforcements and which has as its most important purpose to allow for a better adherence and connection between the external reinforcement and the column, beam or such to be reinforced.

The invention also aims at such external reinforcement which can be realized thicker at the locations where the largest tensile and/or pressing forces occur.

According to the invention, this aim is achieved by an external reinforcement comprising in the combination of fibers and a resin, whereby the majority of the fibers is situated in the longitudinal direction of the reinforcement and whereby at least well-defined portions of the external reinforcement are provided with an additional reinforcement formed by fibers which are arranged according to at least one direction differing from the longitudinal direction of the reinforcement.

DETAILED DESCRIPTION OF THE INVENTION

With the intention of better showing the characteristics of the invention, hereafter, as an example without any limitative character, a preferred form of embodiment of an external reinforcement for beams, columns, plates and such is described which substantially consists in the combination of fibers and a resin.

The aforementioned fibers in the external reinforcement may consist of glass fibers, carbon fibers, aramide fibers or natural fibres, such as hemp, flax, cocos, or a combination of such fibers, whereas the resin preferably is an epoxy resin, a vinyl ester resin, a polyester resin or another suitable kind of resin.

According to the invention, a plate-shaped external reinforcement will be realized whereby not only the majority of the fibers is situated in the longitudinal direction of the external reinforcement, which also is the direction in which a tensile force will be exerted upon the external reinforcement, but moreover, according to the invention, an additional reinforcement is provided, at least in well-defined portions of the external reinforcement, by adding fibers which are situated in at least one direction other than the longitudinal direction of the external reinforcement.

In a particular form of embodiment, the thickness of the external reinforcement may be variable in the longitudinal direction thereof in order to strengthen the reinforcement at the locations where the tensile and/or pressing forces are the largest, for example, in case of an external reinforcement for a beam, in the middle of the length of the beam.

The fibers in the aforementioned well-defined parts are directed such that they cross each other, such that, when drilling through the external reinforcement, the tensile and/or pressing forces are transferred to other reinforcement fibers, which allows for a mechanical anchoring of the external reinforcement to the material to be reinforced, by means of screws, bolts and such.

Moreover, locally a rough surface is obtained, which offers the important advantage that the adherence of the glue increases, as a result of which the reinforcement will take up the forces in a better way.

According to the invention, the external reinforcement can take up forces which are not directed according to the longitudinal direction of the material to be reinforced.

Before being applied on site, the external reinforcement can be provided at one or both sides with a fabric with poor adherence, which fabric, when removed, leaves an impression on the external reinforcement.

By removing this fabric before applying the external reinforcement, also a rough surface is obtained, such that additional treatments, such as sandblasting or scouring of the reinforcement, become redundant.

The aforementioned fabric with poor adherence moreover protects the external reinforcement against pollution, such as fingerprints, dust and such, which might render the glueing of the external reinforcement to the material to be reinforced difficult.

In a particular case, the external reinforcement can be isotropic on well-defined locations.

As an external reinforcement according to the invention, at least at the locations where it is attached by means of glue, bolts or such to a beam, column or such, is provided with additional fibers which are directed otherwise than the longitudinal direction of the aforementioned majority of the fibers, it is obtained that the provision of openings in the reinforcement for passing the aforementioned bolts remains without effect on the tensile or pressing strength of the longitudinally-directed fibers.

In fact, such openings can be provided in said external reinforcement beforehand or afterwards, for example, when manufacturing the reinforcement, more particularly by providing the fibers, previous to the hardening of the resin, in such a manner that they are arranged around the required openings.

The aforementioned fibers which have to provide for the additional strengthening in the external reinforcement, can be formed by fabrics, warp-knit fabrics, mats, fleeces or such consisting of fibers which are arranged at least according to one direction which deviates from the longitudinal direction of the external reinforcement.

At the surface of the external reinforcement, furthermore a fleece, either electrically conducting or not, may be provided, such as, for example, a glassfiber fleece, a polyester fleece or such.

The present invention is in no way limited to the embodiment described in the aforegoing. Such external reinforcement for beams, columns and the like thus can be realized in a variety of forms and dimensions without leaving the scope of the invention.

What is claimed is:

1. A discrete prefabricated reinforcement plate, the reinforcement plate comprising:

a plurality of fibers in a resin matrix, a majority of said fibers positioned generally in a longitudinal direction of said reinforcement plate, said reinforcement plate having at least one supplementary reinforcement portion including a plurality of fibers oriented in at least one oblique direction relative to the longitudinal direction of said reinforcement plate;

wherein the thickness of said reinforcement plate has regions of varying thickness.

2. The discrete prefabricated reinforcement plate according to claim 1, wherein at least a portion of said fibers is formed by a fabric, a warp-knit fabric, mats, fleeces or a combination thereof.

3. The discrete prefabricated reinforcement plate according to claim 1, wherein the fibers are at least partially formed by at least one type of fiber selected from the group consisting of glass fibers, carbon fibers, aramid fibers, natural, synthetic fibers and a combination thereof.

4. The discrete prefabricated reinforcement plate according to claim 1, wherein the resin is selected from the group consisting of epoxy resin, polyester resin, vinyl ester resin, phenole resin, thermoplast resin and combinations thereof.

5. The discrete prefabricated reinforcement plate according to claim 1, wherein at least of a portion of the surface of the reinforcement plate includes an impression defining a roughened surface texture.

6. The discrete prefabricated reinforcement plate according to claim 5, wherein said roughened surface texture is formed by the application and subsequent removal of a fabric with poor adherence on said at least one portion of the surface of the reinforcement plate having a roughened surface texture.

7. The discrete prefabricated reinforcement plate according to claim 1, wherein the thickness along the longitudinal length of the reinforcement plate varies in correspondence to expectant tensile or pressing forces to be exerted thereon.

* * * * *